US006619389B1

(12) United States Patent
Kidd et al.

(10) Patent No.: US 6,619,389 B1
(45) Date of Patent: Sep. 16, 2003

(54) PIPE SPINNING APPARATUS

(75) Inventors: Johnny Clay Kidd, Odessa, TX (US); Freeman Lane Wilson, Odessa, TX (US)

(73) Assignee: Inter-American Oil Works, Ltd., Odessa, TX (US)

( * ) Notice: Subject to any disclaimer, the term of this patent is extended or adjusted under 35 U.S.C. 154(b) by 0 days.

(21) Appl. No.: 09/904,225

(22) Filed: Jul. 12, 2001

(51) Int. Cl.[7] ..... E21B 19/16
(52) U.S. Cl. ..... 166/85.1; 166/78.1; 175/195
(58) Field of Search ..... 166/78.1, 85.1; 175/195

(56) References Cited

U.S. PATENT DOCUMENTS 3,144,085 A * 8/1964 Hasha ..... 173/164
3,592,248 A 7/1971 Cameron
3,906,820 A 9/1975 Hauk
4,099,429 A 7/1978 Hauk
4,423,645 A 1/1984 Abbott et al.
4,630,688 A 12/1986 True et al.
4,678,045 A 7/1987 Lyons
4,744,752 A 5/1988 Nakayama et al.
4,885,962 A 12/1989 Summers
5,396,952 A 3/1995 Stogner
5,660,087 A 8/1997 Rae

OTHER PUBLICATIONS

Internet Article, "Pneuamtic Rotary Actuators" By Motion Control Solucitons, 1998.*

* cited by examiner

*Primary Examiner*—David Bagnell
*Assistant Examiner*—G M Collins
(74) *Attorney, Agent, or Firm*—Winstead Sechrest & Minnick P.C.; Henry L. Ehrlich

(57) ABSTRACT

A pipe spinning apparatus connected in a drilling string for threadably connecting or disconnecting joints of pipes is provided. The pipe spinning apparatus includes a rotatable stem for connecting and disconnecting members, at least one pneumatic, turbine motor rotatably connected to the stem and a throttle control functionally connected to the turbine motor for variably controlling the speed of rotation of the stem. The rotational speed of the stem can be controlled through a range of revolutions per minute (rpm) depending on the air pressure and flow rate provided. The speed may be varied from 0 rpms to at least 500 rpms. A desirable range of operation is from 0 to 200 rpms. This ability to control and vary the speed of the stem greatly increases the safe operation of present kelly spinner over the prior art kelly spinners.

20 Claims, 2 Drawing Sheets

PIPE SPINNING APPARATUS

TECHNICAL FIELD

The present invention relates generally to equipment for making up and breaking out threaded members and more specifically to a drilling rig kelly spinner for making up or breaking a joint of pipe in an oil well drilling operation.

BACKGROUND INFORMATION

In many situations it is necessary to make up, thread together, or break out, unthread, members together. In some commercial applications this process is required on a very frequent basis requiring significant time. For example, during the process of drilling well bores it is continuously required to connect joints of pipe together. This process of making and breaking joints of pipe is time consuming and therefore an expensive process. The process of making and breaking threaded connections is very dangerous and often results in injury to the operators, very commonly known as roughnecks.

A kelly spinner is a well known tool for making up (and breaking out when necessary) a joint of pipe by application of a fixed amount of torque. Use of a kelly spinner can significantly reduce the time required for the joint makeup operation and the potential of spark formation and lost fingers in comparison to spinning chains used for many years.

Kelly spinners typically comprise a geared stem having suitable pipe connections at each end. The stem is installed in the string between a derrick swivel and a kelly joint. A motor then turns the stem which in turn spins the kelly joint to makeup a new joint on the end of the kelly opposite from the kelly spinner.

Spinning chains have primarily been replaced with pneumatic kelly spinners in recent years. The current type pneumatic kelly spinners utilize a vane type air motor and operate at a single, wide open, speed. This type motor requires a surge of air to start it's rotation and must maintain a certain speed to continue rotating. Thus, these prior art kelly spinners can only be operated at full speed (approximately 150 to 200 rpm, depending on the load, when making up or breaking out pipe). This single speed operation of the kelly spinner is a safety hazard, resulting in immediate high speed spinning of the pipe. Which may cause kicking of the pipe or kelly injuring the roughnecks. Additionally, this wide open operation of the prior art kelly spinners increases the wobble in the stem and results in a shorten life of the kelly spinner and damages the other threaded joints within the string. It is a benefit therefore to provide a multi-speed kelly spinner to increase worker safety and increase the operating life of the kelly spinner and the other associated connections within the string.

Another drawback of these prior art, vane type, air motor kelly spinners is the excessive use of pressurized air. Typically, on a drilling rig or at a drilling site, various equipment and numerous tools are pneumatically operated and or controlled. However, due to space limitations and production costs, pressurized air is very often limited at the well site. Therefore, it is desired to limit air flow requirements wherever possible. The prior art type kelly spinners consume approximately 600 standard cubic feet per minute (scfm) at 120 psi to produce 25 horsepower and 93 foot-pounds torque. It is a benefit therefore to provide a variable speed kelly spinner that requires less air flow for operation then the prior kelly spinners.

The current art vane type kelly spinners require a dry, lubricated source of pressurized air for operation. Thus, the prior art kelly spinners require a lubricator and water trap for proper operation. These requirements add to the expense and unreliability of the system. It is therefore an additional benefit to provide a kelly spinner that can operate with a lower quality air source than the prior art kelly spinners.

It is therefore a benefit to provide a kelly spinner having variable operational speeds, increasing safety in the operation of the kelly spinner and reducing wear on the kelly spinner and associated threaded couplings. It is a further benefit to provide a kelly spinner that requires less air flow for operation than the prior art kelly spinners. It is a still further benefit to provide a kelly spinner that reduces the need for lubricators and water traps in the pneumatic system for operation of the kelly spinner. It is a still further benefit to provide a kelly spinner having a bearing system that increases the longevity of the kelly spinner and reduces wear on the associated equipment.

SUMMARY OF THE INVENTION

It is thus an object of the invention to provide a pipe spinning apparatus that having variable operational speeds, increasing safety in the operation of the spinning apparatus and reducing wear on the spinner and the associated threaded couplings.

It is a further object of the present invention to provide a spinning apparatus that requires less air flow for operation than the prior art spinning apparatus.

It is a still further object of the present invention to provide a spinning apparatus reduces the need for lubricators and water traps in the pneumatic system for operation.

It is still further object of the present invention to provide a spinning apparatus having a bearing system that increases the longevity of spinner and reduces wear on the associated equipment relative to the prior art spinners.

Accordingly, a pipe spinning apparatus connected in a drilling string for threadably connecting or disconnecting joints of pipes is provided. The pipe spinning apparatus includes a rotatable stem for connecting and disconnecting members, at least one pneumatic, turbine motor rotatably connected to the stem and a throttle control functionally connected to the turbine motor for variably controlling the speed of rotation of the stem. The rotational speed of the stem can be controlled through a range of revolutions per minute (rpm) depending on the air pressure and flow rate provided. The speed may be varied from 0 rpms to at least 500 rpms. A desirable range of operation is from 0 to 200 rpms. This ability to control and vary the speed of the stem greatly increases the safe operation of present kelly spinner over the prior art kelly spinners.

The kelly spinner of the present invention reduces the need for a lubricator and water trap in the air supply system. These elements are replaced with a strainer to prevent the passage of large particles into the turbine motors.

The kelly spinner of the present invention may also include a novel bearing system. The present kelly spinner includes a full tapered roller bearing set in the top bearing carrier and a straight radial roller bearing in the bottom bearing carrier. This novel bearing arrangement gives stability to the kelly stem when the pipe is being torqued and reduces wear to the stem, labyrinth plates and bearings in comparison to the prior art kelly spinners.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in the figures, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

Figure 1:
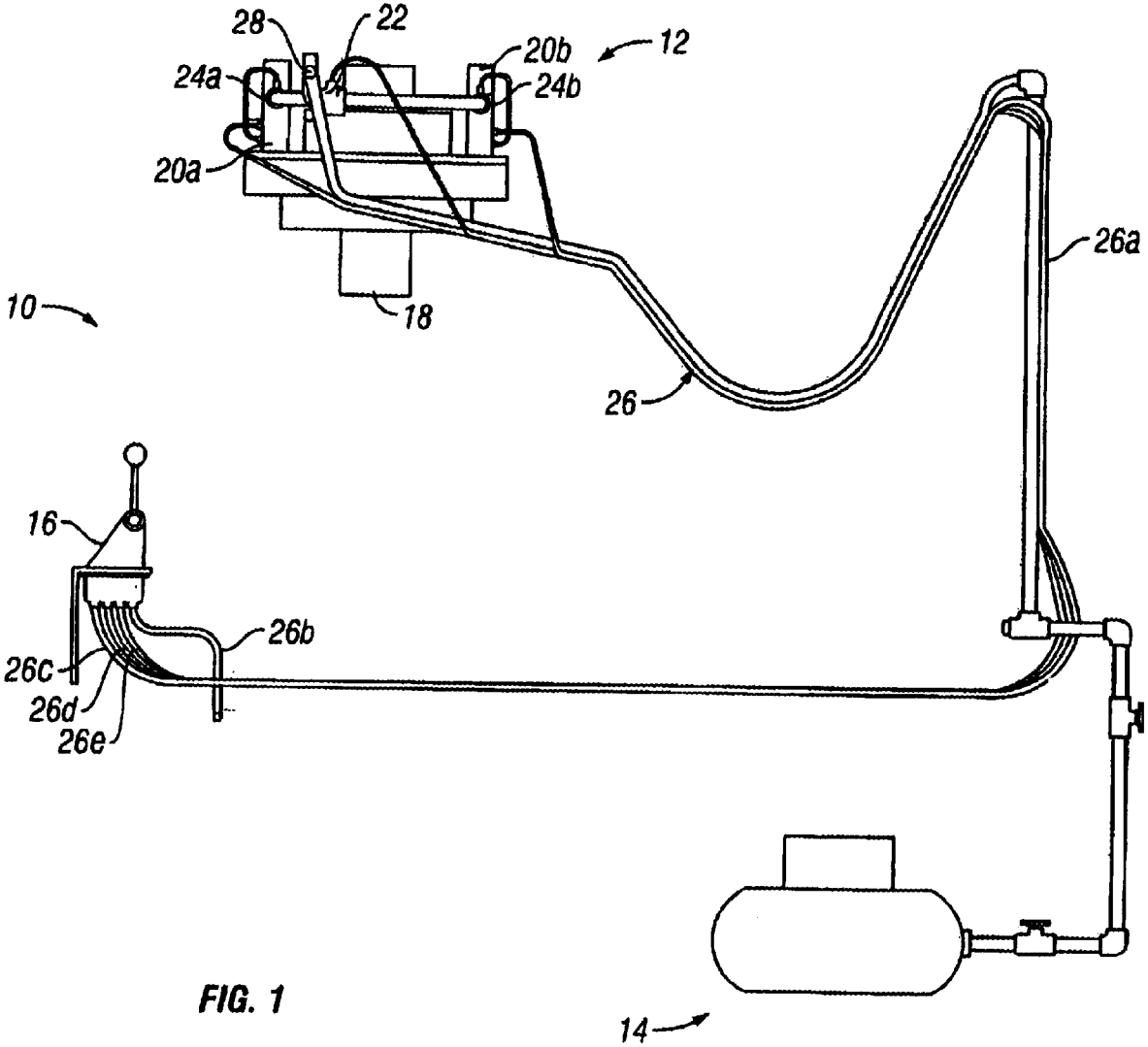
FIG. 1 is a representative view of the pipe spinning system of the present invention.

FIG. 1 is a representative view of the pipe spinning system of the present invention generally designated by the numeral 10. Pipe spinning system 10 is described for brevity as a kelly spinner and described in general for making-up pipe. Pipe spinning system 10 includes a kelly spinner 12, air supply 14, and a throttle control actuator 16. Kelly spinner 12, air supply 14 and throttle control actuator 16 are interconnected via air transport and control lines, designated collectively by the numeral 26.

Kelly spinner 12 includes a stem 18 operationally connected to a make-up air turbine motor 20*a* and a break-out air turbine motor 20*b*. Turbine motors 20 are controllably connected to power air supply 14 via throttle control actuator 16, pilot operated pressure control valve 22 and relays 24*a* and 24*b*. Kelly spinner 12 is described in more detail in relation to FIG. 2.

Kelly spinner 12 further includes a Y-strainer 28 to filter air passing from air supply 14 through a main air source line 26*a*. The utilization of turbine motors 20 eliminates the need for a lubricator and water trap or filter as required by the current art vane type motors. Y-strainer 28 should have a mesh size sufficient to prevent any large debris from being introduced into turbine motors 20.

Throttle control actuator 16 allows for the operational selection of make-up turbine 20*a* or break-out turbine 20*b* through relay valves 24*a* and 24*b*. Supply air is provided to throttle actuator 16 via line 26*b* connected to an air supply. Throttle control actuator 16 is connected to relay valves 24*a* and 24*b* through air supply hoses 26*b* and 26*c*. Throttle control valve 16 is controllably connected to pilot operated pressure control valve 22 via line 26*e*. Through connection to pilot valve 22 flow of air to the selected turbine motor 24 can be controlled thereby controlling the revolutions of the turbine motor 24 and stem 18. These features increase the safety of operation of kelly spinner 12 and increases the longevity of kelly spinner 12 the associated equipment over the prior art kelly spinners.

Figure 2:
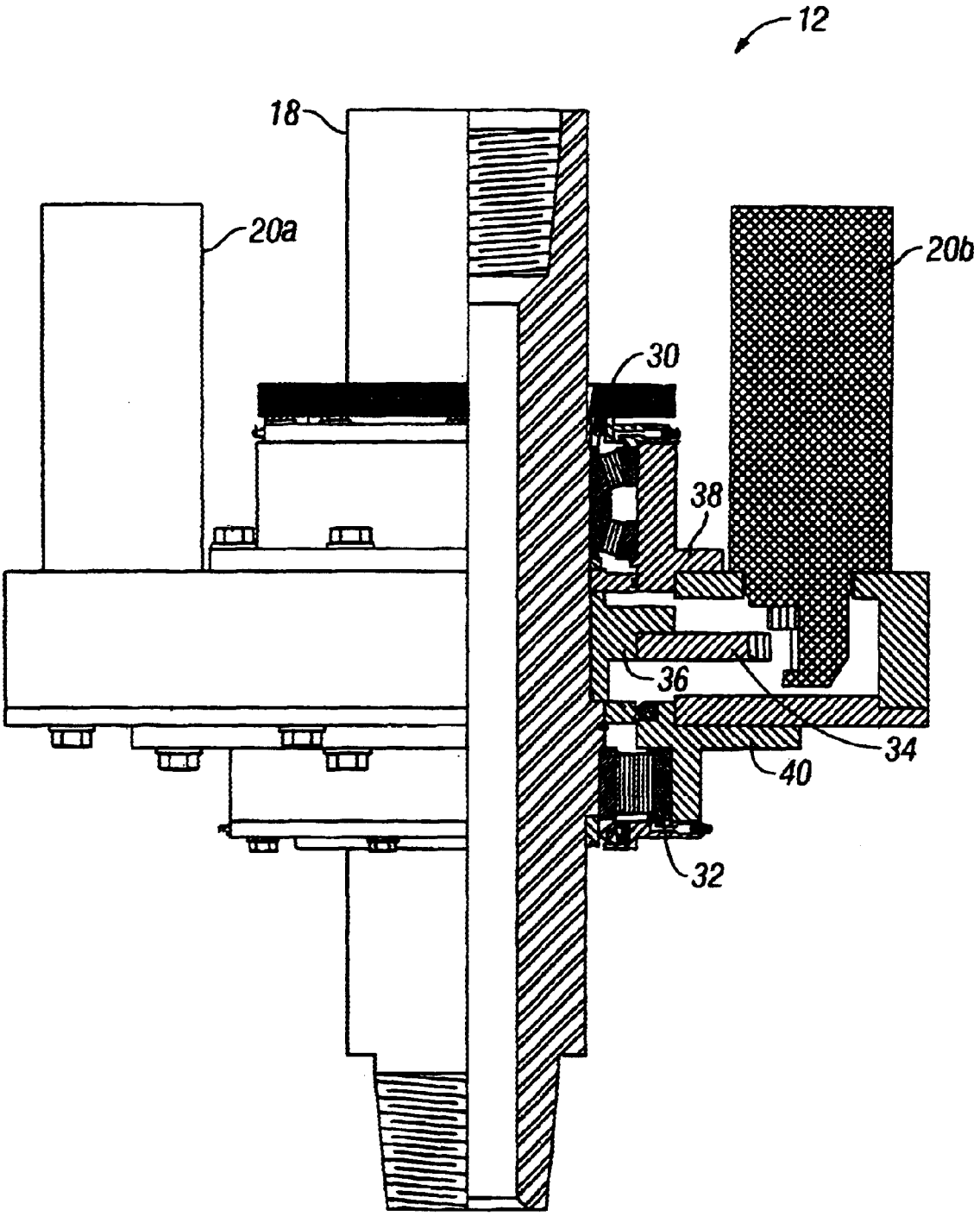
FIG. 2 is a partial cross-sectional view of the pipe spinning apparatus of the present invention.

FIG. 2 is a partial cross-sectional view of kelly spinner 12 of the present invention. Kelly spinner 12 including a make-up turbine motor 20*a*, a break-out turbine motor 20*b*, a stem 18, a top tapered roller bearing set 30 and a lower radial roller bearing 32.

Turbine motors 20 are functionally connected to stem 18 via gear 34 and gear hub 36. As described in relation to FIG. 1, a desired turbine motor 20 is engaged via throttle valve 16 and then the rotational speed of stem 18 is controlled. This ability to control the rotational speed is a significant advancement in safety of operation and the longevity of kelly spinner 12 over the prior art kelly spinners in operation.

Kelly spinner 16 includes a full tapered roller bearing set 30 positioned in the top bearing carrier 38 and in functional contact with stem 18. Kelly spinner 16 further includes a straight radial roller bearing 32, in the lower bearing carrier 40, in functional contact with stem 18. This bearing arrangement stabilizes kelly stem 18 when the pipe is being torqued and eliminates wear to stem 18, bearings 30 and 34 and the labyrinth plates.

The prior art kelly spinners currently utilize a tapered cup and cone bearing in the top bearing carrier and a tapered cup and cone bearing in the bottom carrier.

This prior art arrangement allows the kelly stem to move inside the kelly housing when the pipe is being torqued. This movement in the housing results in wear on the kelly stem and labyrinth plates. Additionally, this prior art arrangement of the bearings provides excessive bearing clearance which is known to result in the premature failure of the bearings.

Operation of kelly spinner system 12 of the present invention is described in reference to FIGS. 1 and 2. Kelly spinner system 10 having a make-up, pneumatic turbine motor 20*a* and a break-out, pneumatic turbine motor 20*b* connected to a kelly stem 18. Kelly spinner 12 further includes a top roller bearing set 30 and a lower roller bearing 32 in functional connection with stem 18 to reduce wear on kelly spinner 12 and increase safety in operation of kelly spinner 12.

Kelly stem 18 is installed in the string between a derrick swivel and a kelly joint. Pressurized air is supplied from supply source 14 to turbine motors 20 through main supply line 26*a*. A strainer 28 is provided in the air supply line 26 so as to prevent the passage of material of sufficient size to damage or prevent the operation of turbine motors 20. Throttle control valve 16 is in operational connection with pilot operated pressure control valve 22, relay valves 24 and turbine motors 20 so as to control the operation and speed of kelly spinner 12. Turbine motor 20 then turns stem 18 which in turn spins the kelly joint to makeup a new joint on the kelly opposite end. Through throttle control 16 an operator can select operation of either turbine motor 20. An example of efficient operation is in the range from approximately 1 to 200 revolutions per minute and providing at 120 psi 37 horsepower and 105 ft-lbs. torque, utilizing approximately 475 standard cubic feet per minute. This range of operational speed provides additional safety to the operators and floor personnel and increases the life of kelly spinner 12 and the associated equipment.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed:

1. A pipe spinning apparatus, said apparatus comprising:

a rotatable stem for connecting and disconnecting members;

at least one pneumatic, turbine motor rotatably connected to said stem; and a throttle control functionally connected to said turbine motor for variably controlling the speed of rotation of said stem from 0 revolutions per minute through 500 revolutions per minute.

2. The spinning apparatus of claim 1 further including a pilot operated pressure control valve in operation connection between said throttle control and said turbine motor.

3. The spinning apparatus of claim 2 further including a strainer within an air supply line to said turbine motor reducing the requirement of a lubricator and water trap.

4. The spinning apparatus of claim 1 wherein said throttle control can control the revolution of said stem from 0 revolutions per minute through 350 revolutions per minute.

5. The spinning apparatus of claim 4 further including a strainer within an air supply line to said turbine motor reducing the requirement of a lubricator and water trap.

6. The spinning apparatus of claim 1 wherein said throttle control can control the revolution of said stern from 0 revolutions per minute through 200 revolutions per minute.

7. The sppinning apparatus of claim 6 further including a strainer within an air supply line to said turbine motor reducing the requirement of a lubricator and water trap.

8. The spinning apparatus of claim 1 further including a strainer within an air supply line to said turbine motor reducing the requirement of a lubricator and water trap.

9. A pipe spinning apparatus, said apparatus comprising:

a rotatable stem for connecting and disconnecting members;

a roller bearing set in functional connection with said stem;

a radial roller bearing in functional connection with said stem;

at least one pneumatic, turbine motor rotatably connected to said stem; and a throttle control functionally connected to said turbine motor via a pilot operated pressure control valve for variably controlling the speed of rotation of said stem.

10. The spinning apparatus of claim 9 wherein said throttle control can control the revolution of said stem from 0 revolutions per minute through 500 revolutions per minute.

11. The spinning apparatus of claim 10 further including a strainer within an air supply line to said turbine motor reducing the requirement of a lubricator and water trap.

12. The spinning apparatus of claim 9 wherein said throttle control can control the revolution of said stem from 0 revolutions per minute through 350 revolutions per minute.

13. The spinning apparatus of claim 12 further including a strainer within an air supply line to said turbine motor reducing the requirement of a lubricator and water trap.

14. The spinning apparatus of claim 9 wherein said throttle control can control the revolution of said stem from 0 revolutions per minute through 200 revolutions per minute.

15. The spinning apparatus of claim 14 further including a strainer within an air supply line to said turbine motor reducing the requirement of a lubricator and water trap.

16. The spinning apparatus of claim 9 further including a strainer within an air supply line to said turbine motor reducing the requirement of a lubricator and water trap.

17. A pipe spinning apparatus, said apparatus comprising:

a rotatable stem for connecting and disconnecting members;

a roller bearing set, positioned in a top bearing carrier, in functional connection with said stem;

a radial roller bearing, positioned in a lower bearing carrier, in functional connection with said stem;

a pneumatic, make-up turbine motor rotatably connected to said stem;

a pneumatic, break-out turbine motor rotatably connected to said stem; and a throttle control functionally connected to each said turbine motor for controlling the speed of rotation of said stem within a range from 0 revolution per minute to 500 revolutions per minute.

18. The spinning apparatus of claim 17 wherein said throttle control can control the revolution of said stem from 0 revolution per minute through 350 revolutions per minute.

19. The spinning apparatus of claim 17 wherein said throttle control can control the revolution of said stem from 0 revolution per minute through 200 revolutions per minute.

20. The spinning apparatus of claim 17 further including a strainer connected within an air supply line to said turbine motors reducing the requirement of a lubricator and water trap.

* * * * *